United States Patent [19]

Champlin et al.

[11] Patent Number: 4,588,077

[45] Date of Patent: May 13, 1986

[54] CARRIER HANDLE

[75] Inventors: Charles L. Champlin, Rittman, Ohio; Arthur A. Olson, Jr., Glenview, Ill.

[73] Assignee: Packaging Corporation of America, Evanston, Ill.

[21] Appl. No.: 324,850

[22] Filed: Nov. 25, 1981

Related U.S. Application Data

[63] Continuation of Ser. No. 46,195, Jun. 6, 1979, abandoned.

[51] Int. Cl.[4] ..... B65D 75/00

[52] U.S. Cl. ..... 206/193; 206/185; 206/198; 229/28 BC; 229/52 BC

[58] Field of Search ..... 206/162, 163–169, 206/193, 198, 185; 229/28 BC, 52 BC

[56] References Cited

U.S. PATENT DOCUMENTS

| | | | |
|---|---|---|---|
| 1,799,657 | 4/1931 | Tinsley | 229/52 BC |
| 2,558,712 | 6/1951 | Williamson | 229/52 BC |
| 2,563,065 | 8/1951 | Price | 206/175 |
| 2,605,034 | 7/1950 | Williamson | 229/52 BC |
| 2,744,675 | 5/1956 | Crane . | |
| 3,955,745 | 5/1976 | Forrer | 229/52 BC |
| 4,240,546 | 12/1980 | Stone | 206/193 |

*Primary Examiner*—Joseph Man-Fu Moy

*Attorney, Agent, or Firm*—Neuman, Williams, Anderson & Olson

[57] ABSTRACT

A carrier handle is provided which is formed from a single blank of foldable sheet material. The carrier handle includes a pair of depending end panels arranged in spaced relation, and a hand-gripping unit interconnecting peripheral portions of the spaced end panels. The unit includes a pair of elongated depending panel sections arranged in substantially face-to-face relation and forming an upright plane disposed in intersecting relation with respect to the end panels. Each panel section is connected to an adjacent end panel by a gusset section.

6 Claims, 14 Drawing Figures

FIG. 1
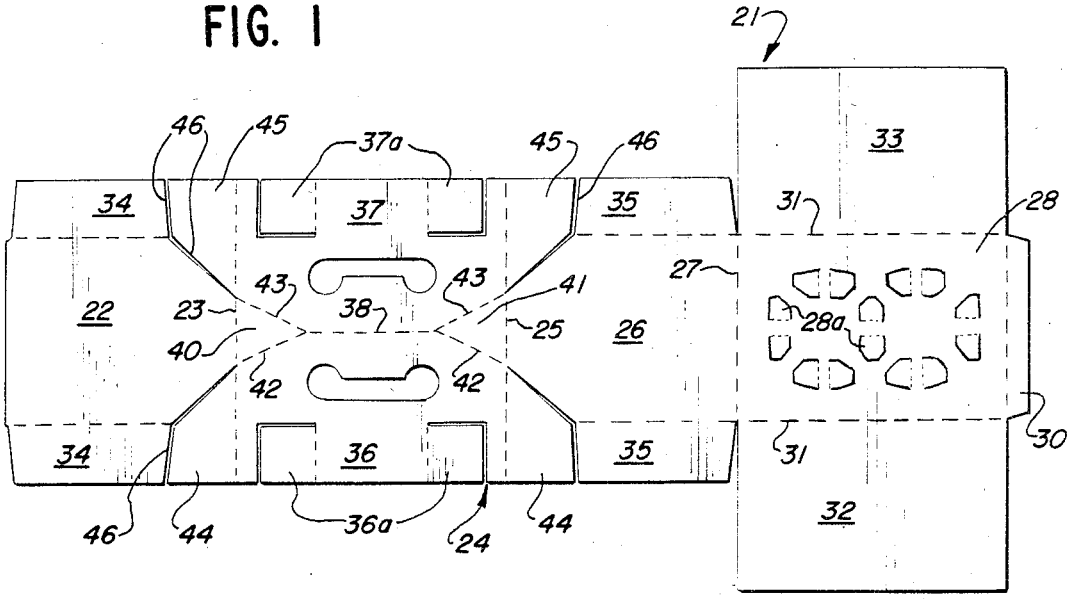
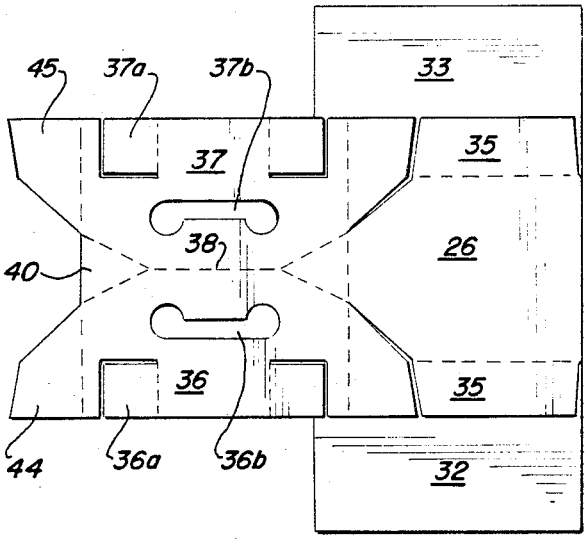
FIG. 2
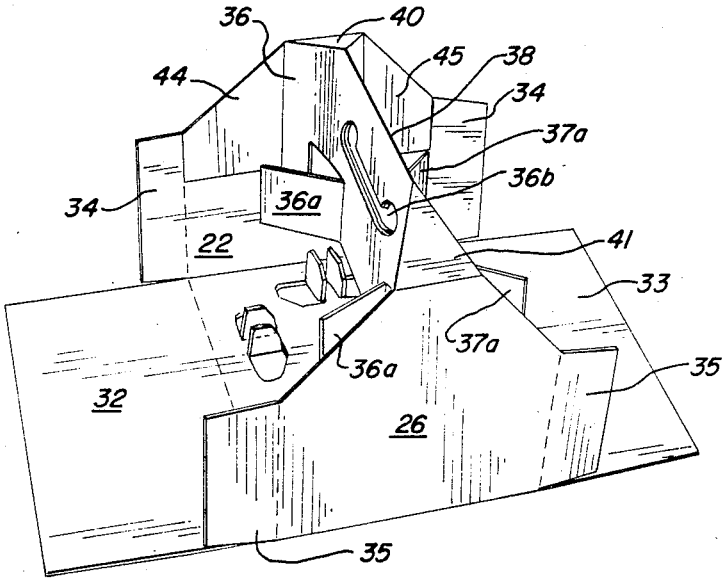
FIG. 3

FIG. 8
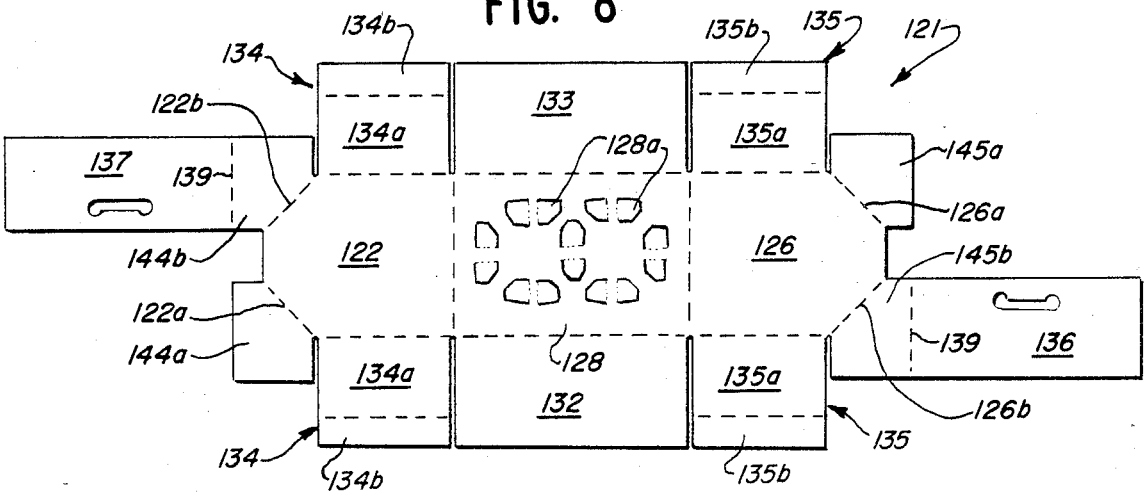
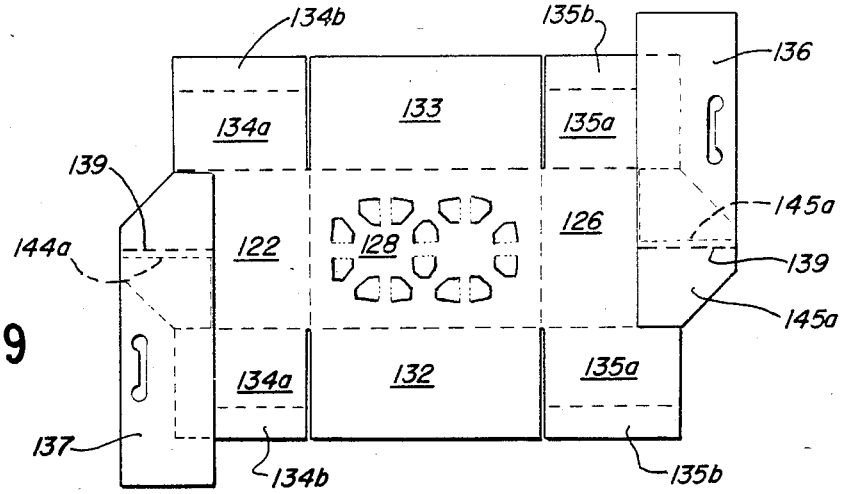
FIG. 9
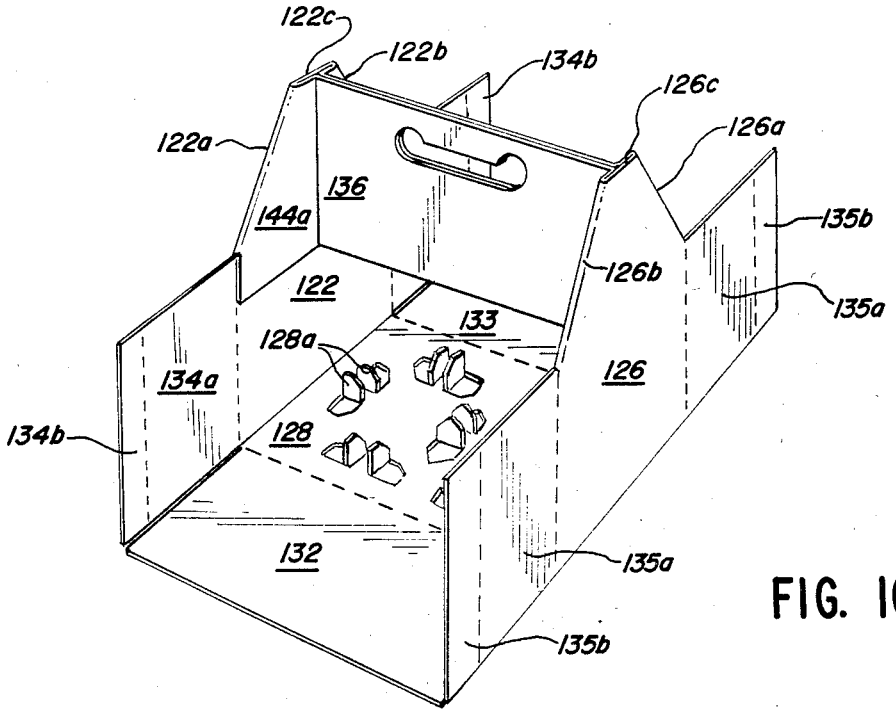
FIG. 10

FIG. 11
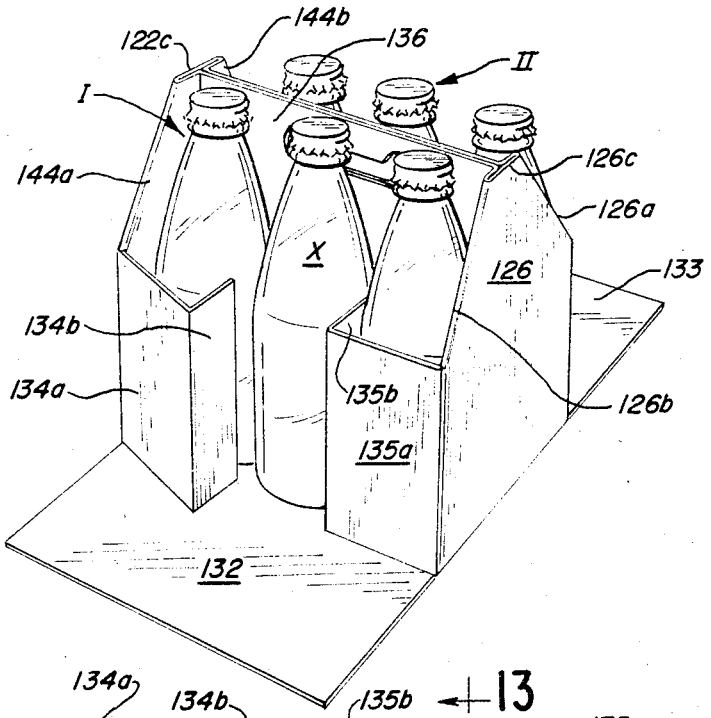
FIG. 12
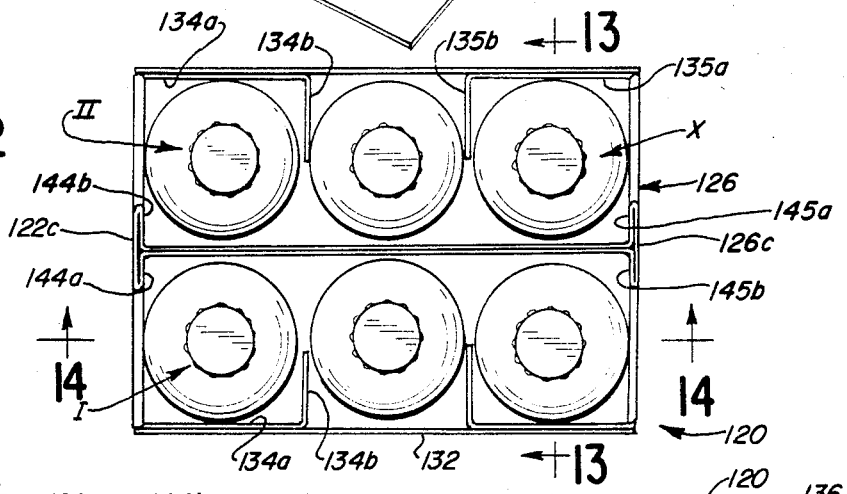
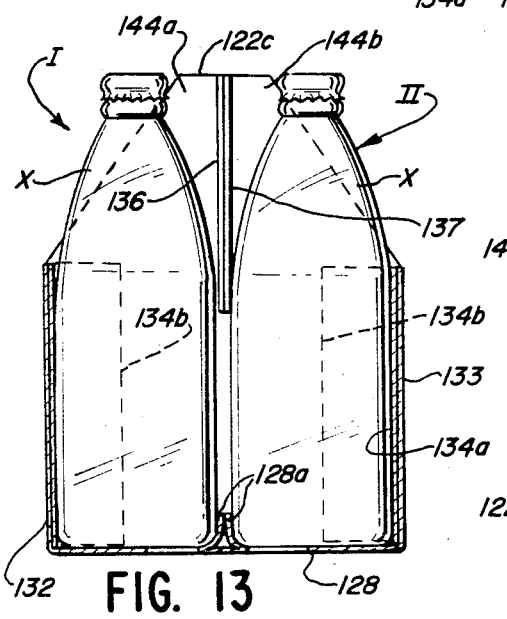
FIG. 13
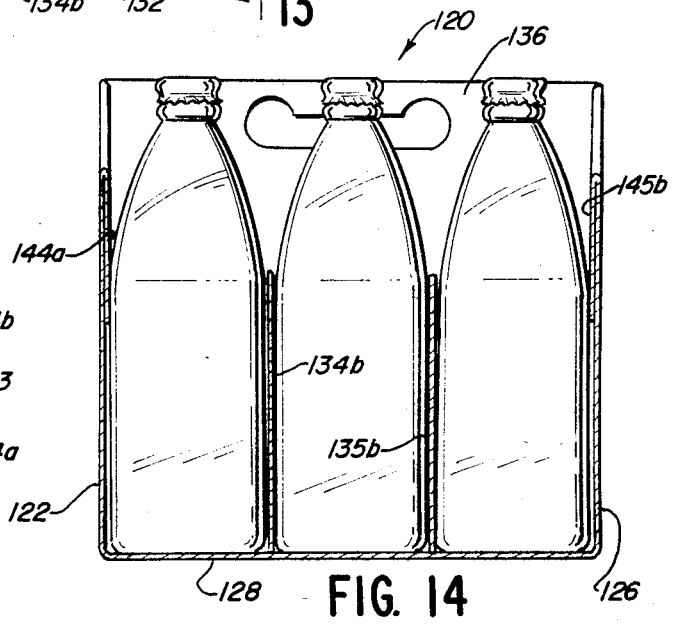
FIG. 14

CARRIER HANDLE

This is a continuation of application Ser. No. 046,195 filed June 6, 1979, now abandoned.

BACKGROUND OF THE DISCLOSURE

With the increased utilization of returnable bottles and similar articles in the present marketing of beverages and the like, it has become increasingly important that a simple, sturdy inexpensive carrier and handle therefor be provided which is capable of handling a plurality of bottles when filled as well as when they are empty.

Heretofore various carriers of this general type and handles therefor have been provided; however, due to certain inherent design characteristics they are beset with one or more of the following shortcomings: (a) one or more complex blanks are required to form the carrier or handle therefor; (b) the folding of the blank, or blanks, to set up the carrier or handle therefor is an awkward and timeconsuming manipulation requiring costly custom designed equipment; (c) the carrier and/or handle therefor is inherently weak and is not comfortable and secure for manually carrying; and (d) the carrier is incapable of accommodating bottles or articles, the shape and size of which may vary over a wide range.

SUMMARY OF THE INVENTION

Thus, it is an object of the invention to provide a carrier and handle therefor which are not beset with any of the foregoing shortcomings.

It is a further object of the invention to provide a carrier and handle therefor which may be adapted for use in manually carrying a variety of products.

It is a further object of the invention to provide a basket-type carrier formed from a single blank of inexpensive foldable sheet material (e.g., paperboard).

It is a still further object of the invention to provide a carrier and handle therefor formed from a blank which is capable of being made and set up by conventional high-speed equipment.

It is a still further object of the invention to provide a carrier which may be readily loaded and unloaded, and provides effective protection for each accommodated bottle or similar article.

Further and additional objects will appear from the description, accompanying drawings and appended claims.

In accordance with one embodiment of the invention, a carrier handle is provided which is formed from a single blank of foldable sheet material. The handle includes a pair of spaced end panels and a hand-gripping unit which spans the distance between and interconnects the end panels. The end panels depend from opposite ends of the hand-gripping unit. The unit includes a pair of panel sections which are disposed in substantially face-to-face relation thereby forming an upright plane which intersects the end panels. The ends of the panel sections are connected to peripheral portions of the end panels by gusset sections. The panel sections are provided with aligned finger openings.

DESCRIPTION

For a more complete understanding of the invention reference should be made to the drawings wherein:

FIG. 1 is a top plan view of one form of blank for an improved carrier and handle therefor.

FIG. 2 is similar to FIG. 1 but showing the blank in a partially folded but collapsed state.

FIG. 3 is a perspective side view of the blank of FIG. 2 squared up for loading.

FIG. 8 is a top plan view similar to FIG. 2 but of a second form of blank.

FIG. 9 is like FIG. 8 but showing the blank in a partially folded but collapsed state.

FIG. 10 is a perspective view of the blank of FIG. 8 squared up for loading.

FIG. 11 is similar to FIG. 10 but showing the bottles in place and the tuck flaps being folded into positions prior to the side panels being folded to upright positions.

FIG. 12 is a top plan view of the carrier set up from the blank of FIG. 8 and fully loaded.

FIGS. 13 and 14 are sectional views taken along lines 13—13 and 14—14, respectively, of FIG. 12.

Figure 4:
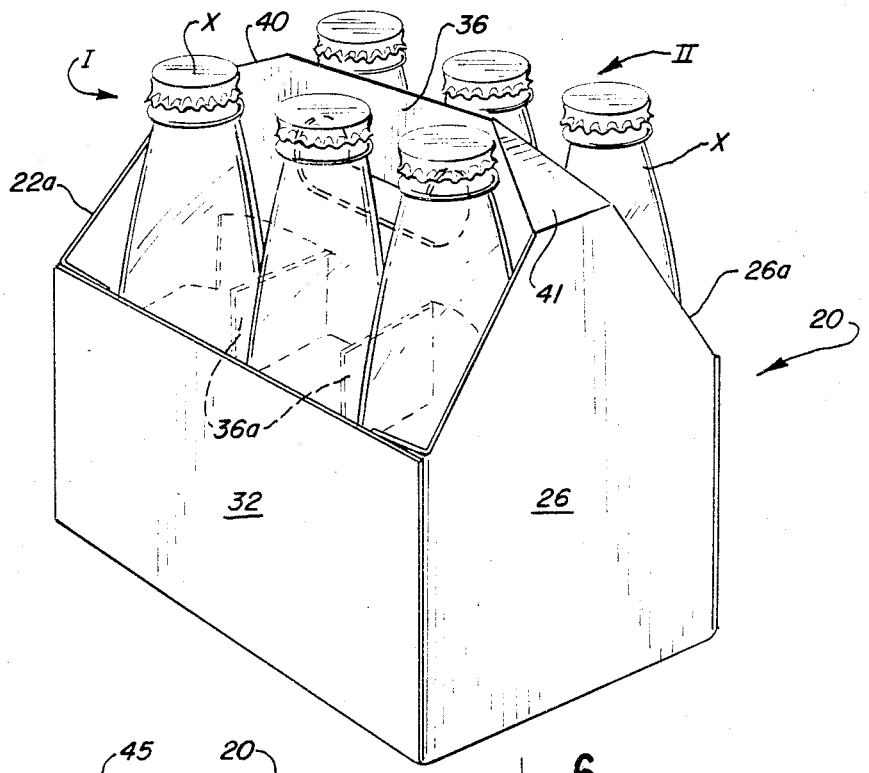
FIG. 4 is a perspective view similar to FIG. 3 but showing a carrier set up from the blank of FIG. 1 and fully loaded.
Figure 5:
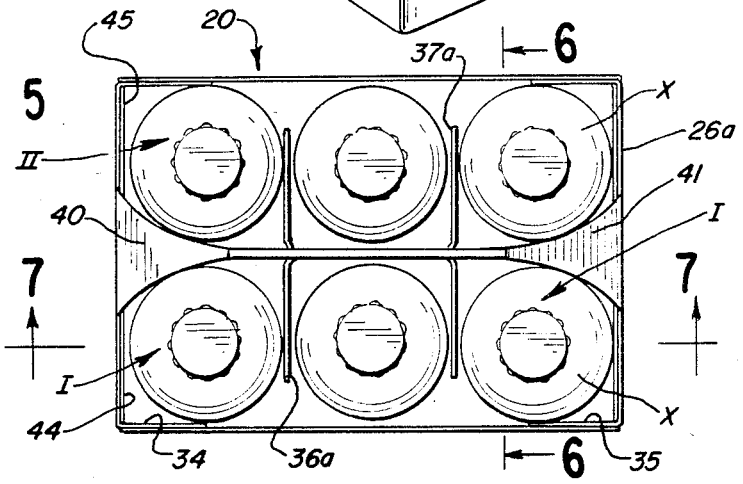
FIG. 5 is a top plan view of the loaded carrier of FIG. 4.
Figure 6:
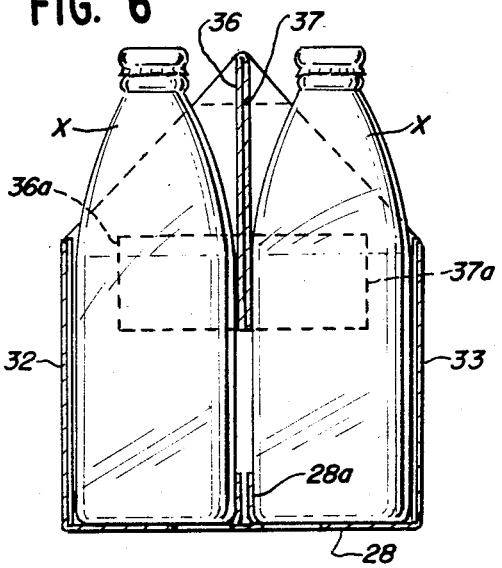
FIG. 6 is a fragmentary sectional view taken along line 6—6 of FIG. 5.
Figure 7:
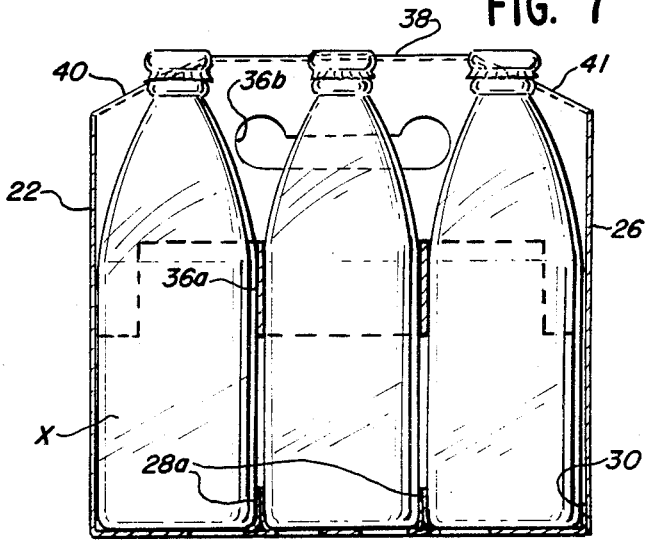
FIG. 7 is a fragmentary sectional view taken along line 7—7 of FIG. 5.

Referring now to the drawings and more particularly to FIGS. 4–7, one form of an improved carrier 20 is shown which is adapted to accommodate a plurality of bottles or similar articles X. In the illustrated embodiment the bottles X are arranged in two parallel rows I and II of three bottles each. The number of bottles or articles comprising a row, as well as the size and shape of the bottle or article, may vary from that shown without departing from the scope of the invention.

The illustrated carrier 20 is formed from a blank 21 of foldable sheet material (e.g., paperboard, preferably finished only on one surface). Such sheet material is well known for this type of use. Blank 21, as seen in FIG. 1, includes at one side thereof a first end panel 22. Next to and to the right of end panel 22, as seen in FIG. 1, and connected thereto by foldline 23 is a hand-gripping unit 24. Connected to the opposite side of unit 24 by foldline 25 is a second end panel 26, which is of substantially the same configuration and size as that of end panel 22. Connected to opposite side of end panel 26 by foldline 27 is a base panel 28. Either base panel 28 or the first end panel 22 may have foldably connected to the periphery thereof a conventional manufacturer's glue flap 30. Connected by foldlines 31 to opposite sides of base panel 28 are side panels 32, 33. In a similar manner tuck flaps 34, 35 are foldably connected to opposite sides of end panels 22, 26, respectively. When the blank 21 is set up to form carrier 20, tuck flaps 34, 35 will be adhesively secured to the side panels 32, 33 as will be described more fully hereinafter.

The hand-gripping unit 24, as seen in FIG. 1, includes a pair of elongated panel sections 36 and 37 which are of like configuration and are connected to one another by a foldline 38. It will be noted in FIG. 1 that the ends of foldline 38 terminate short of the foldlines 23, 25 which connect the respective end panels 22, 26 to the hand-gripping unit 24. Disposed between the ends of foldline 38 and the foldlines 23, 25 are gusset sections 40, 41 which in the illustrated embodiment are of triangular configuration. Foldline 23, 25 forms one side of the respective triangular gusset section 40, 41. The remaining two sides of each gusset section 40, 41 are connected to panel sections 36, 37 by foldlines 42, 43, see FIG. 1.

Foldably connected to opposite ends of each panel section 36, 37 are flaps 44, 45 respectively. As will be described more fully hereinafter, the flaps 44, 45 produce an attractive shadow box effect when the blank is fully set up and loaded. In addition, each panel section 36, 37 may be provided with struck-out spacer tabs **36*a*, 37*a*. Spaced from and disposed on opposite sides of foldline 38 are conventional finger openings 36*b*, 37*b*** which facilitate manually carrying of the carrier when it is loaded.

As noted in FIG. 1, the flaps 44, 45 are separated from the adjacent end panel and associated tuck flaps by cuts 46.

In setting up the blank 21 to form carrier 20, the blank 21 is initially folded so that the glue flap 30 is secured to the interior surface of end panel 22, see FIG. 2. With the blank in its initial folded (collapsed) condition (FIG. 2) the blank may be readily stored or shipped in bulk to the customer (bottler) for subsequent loading.

When the collapsed blank (FIG. 2) is to be loaded, it is squared up so that the end panels 22, 26 assume upright substantially parallel spaced relation, and the panel sections 36, 37 are folded downwardly about foldline 38 into substantially face-to-face relation. When the panel sections assume the face-to-face relation, the panel sections are disposed between the upright end panels and the "shadow box" flaps 44, 45 attached to the ends of the panel sections are cammed by the inclined edge portions **22*a*, 26*a* of the end panels 22, 26** to assume substantially right angles to the panel sections and slidably engage adjacent portions of the interior surfaces of the end panels.

In order to enable the panel sections to assume their depending face-to-face positions, the gusset sections 40, 41 will cause the foldline 38 connecting the upper edge portions of the panel sections to become elevated relative to the foldlines 23, 25 connecting the gusset sections to the upper peripheral portions of the end panels. Thus, as noted in FIG. 7, the gusset sections 40, 41 extend divergently downwardly from the ends of foldline 38 towards the upper peripheral portions of the end panels.

Once the blank has assumed its loading mode, FIG. 3, and the spacer tabs **36*a*, 37*a* of the panel sections 36, 37 are folded so as to project outwardly from the corresponding panel section, two rows of bottles X or similar articles may be fed in opposite directions towards one another by conventional high-speed loading equipment, not shown, through the open sides of the squared up blank until the bottles engage the respective depending panel section. Because of the spacing between the projecting spacer tabs 36*a*, 37*a*, adjacent bottles in a row will have the upper enlarged portions thereof separated from one another by the thickness of the tab sandwiched between the bottles. Prior to loading of the bottles into the squared up blank in a manner as aforedescribed, conventional spacer tabs 28*a*, normally provided on the base panel 28, are pushed upwardly from the base panel and engage the lower portions of the bottles and serve to properly space apart adjacent bottles in a row as well as corresponding bottles in the two rows I and II, see FIGS. 6 and 7**. Thus, clicking between the accommodated bottles and the possibility of breakage is significantly reduced.

Once the rows of bottles have been properly spotted on the base panel 28, the tuck flaps 34, 35 along each side of the carrier are folded towards one another and adhesively or otherwise secured to the corresponding side panel 32, 33 subsequent to the latter being folded to an upright position. When the side panels are retained by the tuck flaps in upright positions, said panels 32, 33; end panels 22, 26; and base panel 28 coact to form an open top chamber for the bottles. The hand-gripping unit 24 is centrally disposed between the upright side panels 32, 33 and the depending panel sections 36, 37 of the unit partially separate the chamber into two contiguous compartments. Each compartment is sized and shaped to accommodate only a single row of bottles. As aforeindicated, depending upon the shape and number of bottles or articles to be accommodated by the carrier, the configuration of the compartments may vary from that shown. For convenience and comfort it is desirable that the bottles or articles be symmetrically arranged with respect to the unit 24.

It is preferred that the foldline 38 between the panel sections 36 and 37, which forms a ridge when the blank is set up, be in substantially coplanar relation with the top surfaces of the accommodated bottles or articles, thereby facilitating stacking of a plurality of loaded carriers.

Because of the central disposition of the unit 24 within the chamber and the narrowness of the unit, removal of the bottles through the open top of the chamber is not obstructed by the unit. Furthermore, manual replacing of an empty bottle into the chamber is readily accomplished without difficulty.

A second version of the improved carrier 120 and the blank 121 therefor is illustrated in FIGS. 8–14. To facilitate understanding of the differences and similarities between the blanks 21, 121 and carriers 20, 120, corresponding parts of the carrier 120 will be identified by the same numerals but in a one hundred series. Blank 121 is formed from a sheet of foldable material (e.g., paperboard finished on only one surface) and includes a base panel 128 which is substantially centrally located within the blank 131. Disposed on opposite sides of base panel 128 and foldably connected to first peripheral segments of panel 128 are end panels 122, 126. Foldably connected to second peripheral segments of the base panel are side panels 132, 133 which assume spaced substantially parallel relation when the blank is set up to form carrier 130. As in the case of carrier 20, the base panel 128, end panels 122, 126 and side panels 132, 133 coact with one another to form a bottle or article accommodating chamber, when blank 131 is set up to form the carrier.

Foldably connected to opposite peripheral portions of the end panels 122, 126 are tuck flaps 134, 135. Each tuck flap includes an inner portion **134*a*, 135*a* which is adapted to be secured to the interior surface of an adjacent side panel when the carrier is formed. The inner portion of each tuck flap assumes a substantially right angle position to the end panel when the blank is set up as seen in FIG. 11. Each tuck flap also includes an outer portion 134*b*, 135*b* which is foldably connected to the respective inner portion 134*a*, 135*a*. When setting up the blank and subsequent to the rows I, II of bottles or articles being spotted on the base panel 128**, the outer portion of each tuck flap is folded relative to the inner portion and inserted between adjacent bottles of a row and functions as a spacer between the bottles thereby reducing breakage or damaging of the bottles or articles during normal handling of the carrier.

As seen in FIG. 8, each end panel 122, 126 has foldably connected to a sloping peripheral portion 122*a*, 126*a* thereof a flap 144*a*, 145*a* which provides a partial shadow box effect at each end of the carrier, see FIG. 10. Foldably connected to a second sloping peripheral portion 122*b*, 126*b* of each end panel 122, 126 is a flap 144*b*, 145*b*. Connected to flaps 144*b*, 145*b* by foldlines 139 are elongated panel sections 136, 137. In the illustrated embodiment, each panel section has a longitudinal dimension which is substantially equal to the spacing between the end panels when the carrier 120 is formed. Each flap 144*a–b* and 145*a–b* is of substantially like configuration and in the initial step of setting up the blank is secured by adhesive or other suitable means in overlying relation with respect to an interior surface segment of the end panel to which it is foldably connected, see FIG. 9. It will be noted that flaps 144*a*, 145*a* are overlaid by panel sections 137, 136, respectively, when the blank is in the collapsed state shown in FIG. 9. With blank 121 in such a state, it may be conveniently stored or shipped in bulk with similar blanks to the customer (bottler) for subsequent loading.

When the blank of FIG. 9 is to be loaded, the end panels 122, 126 and the associated tuck flaps 134, 135; flaps 144*a–b*, 145*a–b*; and panel sections 136, 137 are moved as a unit relative to the base panel 128 so that the end panels assume upright substantially parallel positions. Simultaneously with, or subsequent to, the end panels 122, 126 assuming such positions, the panel sections 136, 137 are folded at right angles to the end panels so that each panel section spans the distance between the end panels and the panel sections are secured to one another in face-to-face relation by adhesive or other suitable means. The panel sections are provided with finger openings which are aligned with one another when the panel sections are in face-to-face relation, see FIG. 10.

As noted in FIG. 13, the vertical dimensions of the panel sections 136, 137 are such that the lower portions of the sections are positioned between the corresponding bottles (or articles) disposed in the two accommodated rows I, II. As in the case of carrier 20, the panel sections 136, 137 of carrier 120 cause the chamber of the carrier to be at least partially formed into contiguous compartments; one being provided for each row of bottles. Prior to the rows of bottles being moved through the open sides of the squared up blank 121, as seen in FIG. 10, the spacer tabs 128*a* formed in the base panel 128 are pushed upwardly in a normal manner and thus, a pair of tabs is disposed between the bottom portions of each pair of adjacent bottles.

Once the rows of bottles I, II are in place, the tuck flaps are folded relative to the end panels so that corresponding flap portions 134*a*, 135*a* are extending towards one another and the flap outer portions 134*b*, 135*b* are inserted between adjacent bottles in a given row, see FIG. 11. It should be noted in carrier 20 that the spacer tabs 36*a*, 37*a* remain relatively stationary while the rows of bottles are moved towards them. On the other hand, in carrier 120 the spacer flaps 134*b*, 135*b* are moved towards relatively stationary rows of bottles. In either case, where the bottles or articles have a generally cylindrical configuration, the rounded exterior surfaces of the adjacent bottles will automatically guide the spacer tab or flap into proper position between the adjacent bottles.

As in the case of carrier 20, the upper peripheral edges of the panel sections of the hand-gripping unit 124 of carrier 120 are in substantially coplanar relation with top edges 122*c*, 126*c* of the end panels 122, 126 and the tops of the accommodated bottles X, thereby facilitating stacking of a plurality of loaded carriers 120.

In variations of the invention illustrated in the drawings, it will be noted that the face-to-face panel sections define a plane which intersects the planes defined by the end panels. Furthermore, the stress imparted to the hand-gripping unit when subjected to carrying loads is a shear force rather than a bending force; thus, resulting in a significant improvement in the rigidity of the unit even when the blank is formed of thinner gauge paperboard.

While the improved handle construction has been described in relation to an entire carrier, it is to be noted however that it is not intended to be limited to such carriers. For example, the improved handle construction may take a form wherein the end panels thereof coact with one another to form a sling-like element, now shown, which would be capable of embracing a separate element, such as a single container. In another adaptation the end panels thereof might have the lower portions thereof removably secured to a package or element without having to embrace same (e.g., each lower portion could have an opening to slidably receive a protuberance formed on the exterior of the package or element).

Thus, it will be noted that the improved handle structure has been provided which is of simple, yet sturdy construction and is capable of being utilized to carry a variety of products.

We claim:

1. A handle and carrier combination for accommodating a plurality of articles arranged in a pair of substantially parallel coextensive rows, said combination being formed from a single blank of foldable sheet material and comprising a pair of end panels of unitary single ply construction arranged in spaced, opposed, substantially upright relation for disposition adjacent opposite ends of the article rows; a hand-gripping unit spanning the distance between said end panels and foldably connected to corresponding upper portions of said end panels, said unit having a portion thereof projecting above a plane defined by the upper portions of said end panels; a base panel of unitary single ply construction for supporting and subtending the article rows and having first peripheral segments foldably connected to and substantially coextensive with corresponding lower peripheral portions of said end panels and disposed in spaced subtending relation with respect to said hand-gripping unit; and side panels of unitary single ply construction foldably connected to and substantially coextensive with opposed second peripheral segments of said base panel and extending upright therefrom for disposition adjacent corresponding article rows being secured to said end panels and coacting therewith to form a chamber having a substantially open top delineated by substantially continuous walls integral with and extending upright from said base panel; said hand-gripping unit including a pair of foldably connected elongated panel sections disposed in substantially face-to-face relation and effecting at least partial separation of the chamber into contiguous compartments, said panel sections having corresponding upper portions thereof foldably interconnected, each compartment being adapted to accommodate a row of articles; the face-to-face panel sections substantially spanning the distance between said end panels and defining a substantially upright plane intersecting planes formed by said upright end panels, the upright plane of said panel sections being in spaced relation with respect to said upright side panels, and gusset sections, each gusset section being interposed the upper portion of an end panel and the folding connection between the panel sections and having first peripheral segments foldably connected to the panel sections and a second peripheral segment foldably connected to the upper portion of an adjacent end panel.

2. The combination of claim 1 wherein the gusset sections are of triangular configuration and disposed intermediate the ends of the folding connection between the panel sections and the adjacent end panels; the folding connection being in spaced substantially parallel relation with the foldline connections between the side panels and said base panel.

3. The combination of claim 1 wherein each end panel includes upright tuck flaps foldably connected to opposite second peripheral portions of said end panels, said tuck flaps being secured to said side panels and retaining same in upright positions, each tuck flap being provided with an spacer tab extending angularly into an adjacent compartment of the chamber.

4. The combination of claim 1 wherein each panel section of the handgripping unit has a lower portion thereof depending a substantial distance into said chamber for effecting substantial separation between the rows of accommodated articles, said depending lower portion being provided with at least one spacer tab extending transversely therefrom into an adjacent compartment of the chamber for disposition between adjacent articles in a row.

5. A single blank of foldable sheet material for use in forming a handle and carrier combination for accommodating a plurality of articles arranged in a pair of spaced, substantially parallel, coextensive rows, said blank comprising an elongated hand-gripping unit; a pair of end panels having upper edges connected by substantially parallel first foldlines to opposite ends of said elongated unit; a base panel connected by a second foldline to a bottom edge of one of said end panels, said first and second foldlines being in substantially parallel relation; and a pair of side panels connected by a pair of substantially parallel third foldlines to opposite sides of said base panel, each side panel being substantially coextensive with the side of the base panel to which it is connected, said third foldlines being substantially transversely disposed relative to said second foldline; said unit including a pair of elongated panel sections arranged in side-by-side substantially coextensive relation and having corresponding first peripheral portions interconnected by at least one fourth foldline, corresponding second peripheral portions of said panel sections opposite said first peripheral portions defining in part the outer periphery of said blank, said fourth foldline being transversely disposed relative to said first foldlines, the ends of said fourth foldline being spaced from said first foldlines and connected thereto by a pair of gusset sections, each gusset section having a first peripheral segment thereof connected to an adjacent end panel by one of said first foldlines and second peripheral segments connected to adjacent panel sections by fifth foldlines, each fifth foldline being angularly disposed relative to said first foldline; when said blank is set up, said base, side, and end panels coacting to form a chamber having an open top dilineated by substantially continuous walls integral with and extending upright from the base panel, and said handgripping unit extending between said end panels and being disposed in spaced relation above said base panel, the panel sections of said unit assuming a substantially face-to-face relation and extending towards said base panel, said face-to-face panel sections substantially defining a common plane substantially perpendicular to said base panel and forming the chamber into substantially contiguous compartments in which the rows of articles are accommodated, said face-to-face panel sections being adapted to effect separation of the rows of accommodated articles.

6. The blank of claim 5 wherein each panel section of the hand-gripping unit is substantially coextensive with the side panels, when said blank is set up, each panel section having a pair of flaps connected to opposite ends thereof by sixth foldlines, each sixth foldline being in substantially aligned endwise relation with respect to a first foldline and in angular relation with respect to a fifth foldline, each flap being separated by a slit from the periphery of an adjacent end panel.

* * * * *

UNITED STATES PATENT AND TRADEMARK OFFICE

CERTIFICATE OF CORRECTION

PATENT NO. : 4,588,077

DATED : May 13, 1986

INVENTOR(S) : Charles L. Champlin and Arthur A. Olson, Jr.

It is certified that error appears in the above-identified patent and that said Letters Patent is hereby corrected as shown below:

Column 6, line 22, "now" should be --not--.

Column 6, line 57 "and" should be inserted after "rows".

Signed and Sealed this

Tenth Day of February, 1987

*Attest:*

*Attesting Officer*

DONALD J. QUIGG

*Commissioner of Patents and Trademarks*